US006257098B1

(12) United States Patent
Cirone

(10) Patent No.: US 6,257,098 B1
(45) Date of Patent: Jul. 10, 2001

(54) ARTICLE COLLATION FEATURE AND METHOD

(76) Inventor: Paul F. Cirone, 71 Old Pond Rd., Great Neck, NY (US) 11023

( * ) Notice: Subject to any disclaimer, the term of this patent is extended or adjusted under 35 U.S.C. 154(b) by 293 days.

(21) Appl. No.: 08/763,087

(22) Filed: Dec. 10, 1996

(51) Int. Cl.[7] ..... B25B 13/02
(52) U.S. Cl. ..... 81/119; 81/121.1; 81/DIG. 5
(58) Field of Search ..... 81/119, 121.1, 81/180.1, DIG. 5

(56) References Cited

U.S. PATENT DOCUMENTS

| | | | | |
|---|---|---|---|---|
| 4,936,170 | | 6/1990 | Zumeta . | |
| 4,947,713 | * | 8/1990 | Arnold | 81/DIG. 5 |
| 4,982,627 | * | 1/1991 | Johnson | 81/121.1 |
| 5,031,488 | | 7/1991 | Zumeta . | |
| 5,079,978 | * | 1/1992 | Kupfer | 81/119 |
| 5,181,439 | * | 1/1993 | Schwartz | 81/119 |
| 5,236,527 | | 8/1993 | Brodsky . | |
| 5,390,964 | | 2/1995 | Gray, Jr. . | |
| 5,395,137 | | 3/1995 | Kim . | |

* cited by examiner

*Primary Examiner*—James G. Smith
(74) *Attorney, Agent, or Firm*—Wechsler & Wechsler, P.C.; Lawrence I. Wechsler

(57) ABSTRACT

A collation feature permits rapid substitution of like size tool members between the families of tools by comparison of a common visual indicator assigned to commonly sized members of analogous tools having differing structural configuration. The visual indicia, advantageously disposed in a prominent position on the tool for unobstructed viewing, and includes at least one non-numerical identifying parameter, in the form of a color, combination of colors, and/or recognizable pattern. When a user of such tools discovers that he requires a different style wrench better suited to the application, he simply notes the pattern or color marked on the tool he is using and requests, for example, that his assistant hand him a differently configured tool designed for performing the same tool operation and carrying the same visually recognizable marking. An embodiment of the invention includes a kit, with which components for commonly marking tools of like size in each of various tool families can be provided so that the user has at hand, with purchase of a kit, all that is needed to achieve that end.

15 Claims, 1 Drawing Sheet

ARTICLE COLLATION FEATURE AND METHOD

BACKGROUND OF THE INVENTION

The present invention relates to collation of various article types having differing structural configuration, yet designed to perform an analogous function, collated ones all sharing a commonality of a particular selected element, such as size, and more particularly a feature, which when, for example, incorporated in a tool design, permits rapid and facilitated selection of commonly sized tools performing analogous functions, but having differing structural configuration.

Hand tools of common structural configuration are generally available in a wide range of sizes, each adapted for use on a matching size workpiece, conveniently provided either as a complete set or for individual purchase. For example, a particular set (or family) of wrenches, each member thereof being of fixed size, is typically directed either to metric or English units. Each member is correspondingly sized to match the dimensions of the nut or bolt head being worked upon. A size marking is generally provided on each wrench of the set by the manufacturer, typically in the form of an imprinted numerical representation, and generally corresponds nominally to the measurement across flats on the nut or bolt head. This enables the user to identify the proper size tool for the task when the size of the workpiece is known. However, often the user of such tools is unaware of the size of the nut or bolt, and must therefore guess the correct size wrench, resulting in a potentially time consuming process until the proper size is finally determined. Furthermore, when, as is frequently the case, the repair task is performed beneath a vehicle or where lighting conditions are poor, reading of the imprinted numerical indicia is difficult.

The above stated problems have been addressed in the prior art in an attempt to alleviate the time consuming nature of correct tool size selection. Various color coding schemes have been suggested by various individuals as providing an effective solution.

For example, one such system is described in U.S. Pat. No. 4,947,713 issued to Arnold, in which an elastomeric sleeve, carried on a wrench socket, contains a color coded representation in which a particular color corresponds to a socket size, thereby simplifying visual recognition and correct selection of a desired size.

In U.S. Pat. Nos. 4,936,170 and 5,395,137, both issued to Zumeta, and in which a similar approach is adopted, the use of a mathematical correlation scheme relating colors to wrench sizes is suggested as a means for enabling color coding of a set of tools in which individual members, each with a discrete size, are more numerous than the colors available for coding. According to the system disclosed therein, a set of tools, all of like configuration, are divided into sub-sets, or groups, each tool in the group related to one another by a mathematical relationship. For example, all tools of even inch size, i.e. 1", 2", 3", etc, would comprise one group and would be represented by a single color. Similarly, fractionally sized tools incrementally spaced by a fixed amount would comprise additional groups, each assigned a particular color representation. The increments between members within each group would be selected to be sufficiently large to permit them to be easily distinguished visually.

U.S. Pat. No. 4,982,627 issued to Johnson is also directed to a color coding scheme for identifying various tool sizes. The use of color bands corresponding to a color chart defining each of ten colors in terms of a corresponding one of ten arabic numbers. Multiple bands of various spacing are used to represent whole number and fraction portions of the particular tool size.

The above inventions are effective in facilitating recognition of a particular tool size, enabling a user of tools incorporating the features claimed therein to quickly select a tool of matching size to a workpiece, such as a nut or bolt. They all, however, rely on the assumption that the size of the nut or bolt head is known to the mechanic, and the inventions described above are then only concerned with the correct matching of one member from a single set of like structured tools by visually selecting an assigned color marked thereon representative of the numerical size of the workpiece measured across the flats. As illustrated above, the prior art does not address a significant remaining problem posed to a mechanic, which may be summarized as follows. Many times, a mechanic may wish to store a variety of different tool sets, i.e different families of tools, mixed together in a single tool case. For example, a mechanic may carry to a work site a box containing a set of box wrenches, a set of open end wrenches, a set each of deep and standard sockets, with each of the above sets including differently sized members. Although each family type is designed to perform an analogous task or function, i.e. tighten or loosen a bolt or nut, depending upon the location and orientation of the nut or bolt, one family or set may be more suitable for the particular application, and the mechanic may not readily know which is best suited for the purpose until a particular wrench is tried. Once a correct fit is determined for a nut or bolt of unknown size, he may then wish to quickly select a commonly sized tool from a remaining one of the tool families of the many sets brought to the job site. The prior art does not provide a solution to the above problem of performing this collation task in a facilitated manner.

There is therefore the need for a collation system, in accordance with which, after determining a correct fit of a member of a particular set of tools with the size of a workpiece such as a nut or bolt by initial trial, a user of such tools, or an assistant, might quickly and easily visually locate a commonly sized member of a functionally analogous family of tools better structurally suited to the application at hand than the tool configuration originally selected.

OBJECTS AND SUMMARY OF THE INVENTION

Accordingly, it is an object of the invention to provide a system for size collation of tools and other articles which overcomes the drawbacks of the prior art.

It is a further object of the invention to provide a system for size collation which, when included as a design feature of hand held tools, permits rapid collation of like sized members of analogous tool families.

It is a still further object of the invention to provide a size collation system either as a feature included during manufacture, or as a part of a kit for application to existing conventional tools and articles.

Briefly stated, there is provided a collation feature by which a common visual indicator is assigned to commonly sized members of functionally analogous tools having differing structural configuration, thereby permitting rapid substitution of like size tool members between the various families of tools. The visual indicia is advantageously disposed in a prominent position on the tool for unobstructed viewing. Furthermore, the visual indicia includes at least one non-numerical identifying parameter, such as for example a color, combination of colors, recognizable pattern and/or shaped region. Since a mechanic often relies upon an assistant to hand him tools during a repair, for example when the mechanic is on a ladder or other location remote from his tool box or case, the pattern or color used to mark a particular common tool size is advantageously of the type that can be easily described in verbal terms. For example, suitable patterns would include dots, stripes, plaids, diamonds, and the like, all easily distinguishable for one another to avoid confusion. In this way, when the person using for example a box wrench marked with blue plaid indicia discovers that he requires a different style wrench better suited to the application, he simply notes the pattern or color marked on the tool he is using and requests, for example, that his assistant hand him a socket wrench carrying the same marking, i.e. in the present example, blue plaid. Since the visual indicia are primarily for purposes of collating like sized tools of differing structure, and not for initial selection of tool size, there is no need that the patterns or colors be assigned any particular relation to size. It is merely important that like size tools all be given visually consistent indicia. Furthermore, in accordance with various embodiments contemplated herein, indicia may be applied to the tools by the manufacturer in consistent manner for commonly sized members of sets of various tool families, each family having differing structure, or may be alternatively user applied after purchase as desired.

The present invention is particularly suited to its embodiment as a kit with which components for commonly marking tools of like size in each of various tool families can be provided so that the user has at hand, with purchase of a kit, all that is needed to achieve that end. Such a kit would contain a plurality of user selectable marking means, such as for example, variously configured bands, each particularly suited for application to a corresponding article type to be marked, of one of the several families of articles having differing structural configuration. In an advantageous embodiment, the variously configured bands are constructed from a heat shrinkable material to permit fixed application to the various types and sizes of tools or articles by application of heat.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

A collation feature is provided in accordance with which a common visual indicator is assigned to commonly sized members of functionally analogous tools having differing structural configuration, to permit rapid substitution of like size tool members between the families of tools. Although described herein with particular regard to its embodiment for use with tools, it is noted that the invention may also find useful application for use with other article types designed to perform an analogous function, thereby permitting rapid collation of members of sets each having differing configuration from remaining sets, the collated members having commonality of a particular selected element, for example, size.

Figure 1:
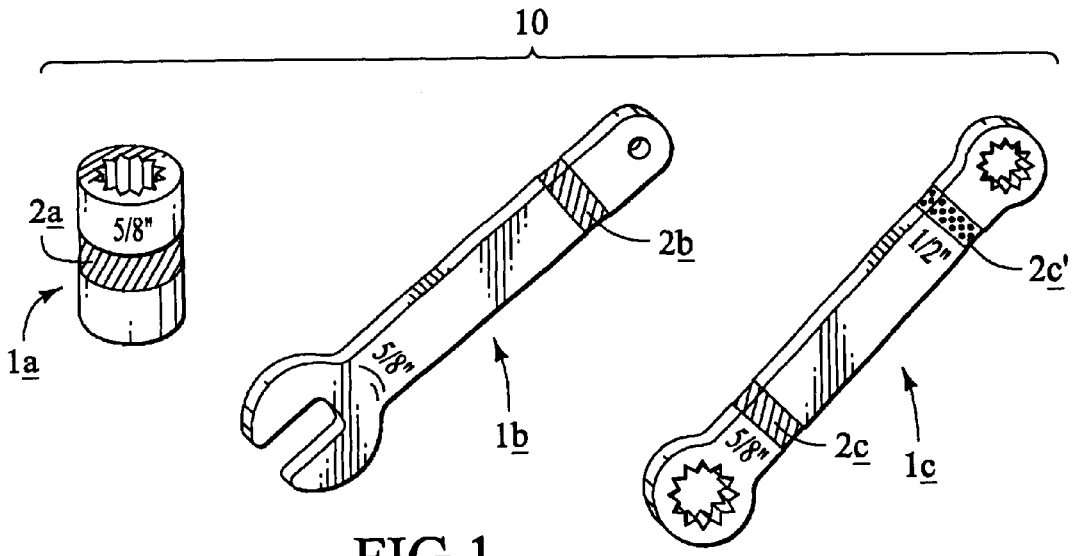
FIG. 1 is a perspective view of commonly sized members of three families or sets of wrenches, including a socket, open end and a box wrench, incorporating thereon the tool collation feature in accordance with an embodiment of the invention.

Referring now to FIG. 1, an embodiment in accordance with the invention is depicted, which is directed to collation of commonly sized tools of various structural configurations. A collated group of tools 10 is shown, and includes individual members of three tool sets, each of such sets being functionally analogous yet presenting differing structural configuration. The three members of collated group 10 includes, for example, as shown, a socket wrench 1*a*, an open end wrench 1*b*, and a double sided box wrench 1*c*. Each of the three collated tools 1*a*, 1*b* and 1*c* in collated group 10 belong to a set or family of tools having a common structural configuration yet differently sized, the remaining members of such sets not being herein shown. The terms "set" and "family" are herein used interchangeably to describe a particular group of differently sized tools of common structural configuration. For example, socket wrench 1*a* may be one of several other socket wrenches, each incrementally sized to operate on a particular workpiece, which in the present example would be a nut or bolt. The socket wrenches of all sizes are referred to collectively as a family, or set of wrenches, in that all members possess a unique structural form distinct from other distinct families of wrenches, such as an open end wrench set and a box wrench set from which open end wrench 1*b* and box wrench 1*c* were themselves respectively selected, the latter two types of wrenches belonging to their own distinct family or set.

The example chosen for illustrative purposes as depicted in FIG. 1 includes wrenches suited for operation with nuts or bolts having a measurement across the flats thereof of ⅝". Box wrench 1*c* is of a commonly available design in which a single wrench is suited for use with two sizes, carried on opposed ends of body of box wrench 1*c*. As shown, one end of box wrench 1*c* is suited for use with a ⅝" nut, and the other for one measuring ½". Each member of group 10 carries visual indicia, conveniently in the form of a band 2*a*, 2*b* and 2*c*, advantageously disposed in a prominent position on each of wrenches 1*a*, 1*b* and 1*c* to permit unobstructed viewing by the user. Bands 2*a*, 2*b* and 2*c* (shown striped for clarity of illustration only) include at least one non-numerical identifying parameter, in the form of a color, combination of colors, and/or recognizable pattern. Box wrench 1*c* also includes a second indicia band 2*c*' at an opposed end thereof (shown as a dotted pattern for illustration purposes only), corresponding to the ½" wrench opening. It will be understood that in accordance with the invention, a commonly sized wrench, i.e. one suited for use with a ½" workpiece, selected from another wrench family, will also carry indicia matching that of dotted band 2*c*'. It is further contemplated within the scope of the invention that another box wrench or other multiple sided wrench may be ½" sized on one end and ⅜" sized on a remaining end. In this instance, such wrench would include a dotted pattern marking matching band 2*c*', indicating collation to the ½" wrench opening of box wrench 1*c*, and another selected pattern or color distinct from each of striped bands 2*a*, 2*b* and 2*c* as well as dotted band 2*c*', for example a band having a plaid pattern (not shown).

Since a mechanic often relies upon an assistant to hand him tools during a repair, for example when the mechanic is on a ladder or other location remote from his tool box or case, the pattern or color used to mark a particular common tool size is advantageously of a type that can be readily described in verbal terms. For example, suitable patterns would include dots, stripes, plaids, cross-hatched, and the like, all easily distinguishable for one another to avoid confusion. In this way, when the person using for example a box wrench marked with blue plaid indicia discovers that he requires a different style wrench better suited to the application, he simply notes the pattern or color marked on the tool he is using and requests, for example, that his assistant hand him a socket wrench carrying the same marling, i.e. in the present example, blue plaid. Since the visual indicia are primarily for purposes of collating like sized tools of differing structure, and not for initial selection of tool size, there is no need that the patterns or colors be assigned any particular relation to size. That is, indicia of a particular color and/or pattern may be arbitrarily matched to a given size. It is merely important that like size tools all be given visually consistent indicia.

Although shown in the embodiment depicted in FIG. 1 in the form of recessed bands, the nature of the visual indicia in accordance with various embodiments contemplated herein may include any other suitable marking means, such as, for example, an insulated plastic handle of a particular color of elastomeric plastic applied as a fitted sleeve. It is further noted that the metal of which the tool is constructed may be imparted colored by anodizing or other suitable process.

Figure 2:
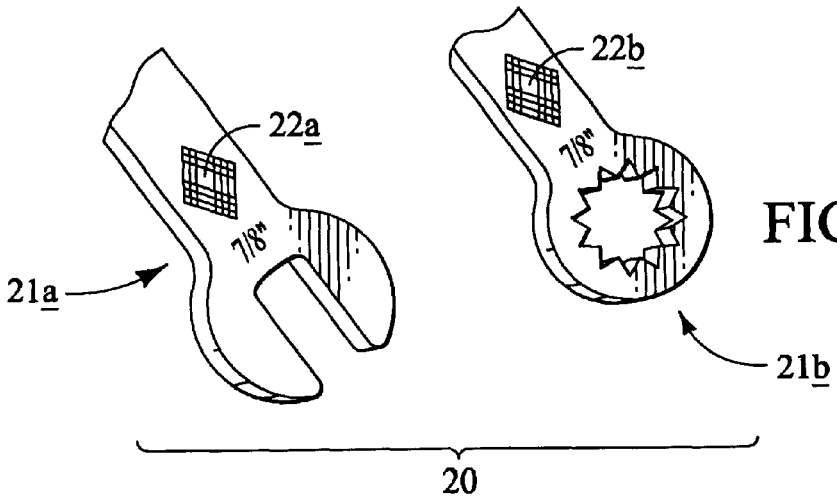
FIG. 2 is a partial perspective view of a tool of commonly sized members of two families or sets of wrenches, including an open end and a box wrench, incorporating thereon the tool collation feature in accordance with another embodiment of the invention.

In a further embodiment, the visual indicia may be further distinguished by selection of a particular discrete shape of the region of marking. Turning now to FIG. 2, a collated group of tools 20 of common size (⅞" in the depicted example) comprises a pair of tools selected from two tool families, including an open end wrench 21*a* and a box wrench 21*b*. Although only two tools are shown for illustration purposes, it is understood that many other commonly sized functionally analogous tools of differing configuration can be like marked and be included in collated group 20. Each of collated group 20 carries a marked region 22*a* and 22*b*, advantageously disposed for unobstructed viewing. Marked regions 22*a* and 22*b* on open end wrench 21*a* and box wrench 21*b*, respectively, are formed in a particular selected shape, which in the depicted example is a diamond. As noted above, there in no requirement that the shape selected for the indicia marking be matched to a particular size, so long as any marking chosen to represent a particular size be used to consistently mark all commonly sized wrenches in all different tool families, to allow reliable size correlation and tool substitution once one wrench is found to match a particular workpiece. In the example depicted in FIG. 2, a diamond shaped plaid region (for example of red color) has been arbitrarily selected to represent all tools sized ⅞". It is understood that numerous other shapes may be used for marked regions 2*a* and 2*b*, including, for example, circular, square, diamond or other recognizably shaped marked areas of a designated color and/or pattern. Use of such shaped correlation regions makes available numerous additional discrete collation identifying markings by adding an additional parameter to the tool indicia. "Parameter" as used herein is defined as any one of many distinguishing factors used to create the indicia marked on the article. For example, a tool marked with a color arranged as a pattern comprises two parameters. Forming such marking into a particularly shaped region would add a parameter, bringing the total to three. A user of such marked tools may ask an assistant, for example, for an open end wrench having a red plaid diamond (the embodiment as depicted), or alternatively a blue striped square shaped marking if such were instead used to represent the particular size found to match a workpiece. It is noted that although a requirement of the invention is that at least one such parameter be non-numerical in nature, as disclosed in the preceding embodiment, a region in the shape of a number and having a color and/or pattern is deemed to be within the intended scope of the invention, the numerical shape being considered a parameter supplementary to the required at least one non-numerical parameter.

In furtherance of the intended scope of the invention, indicia may be applied to the tools by the manufacturer in consistent manner for collation of commonly sized members of sets of various tool families, each family having differing structure from remaining tool families, or may be alternatively user applied after purchase, as desired. The latter may be conveniently accomplished by user-applied paint, which would be supplied in small bottles in a variety of colors, for example, much like commercially available nail polish. Another example includes heat shrinkable bands of various sizes suited for application to tools in a convenient position thereon. Yet another example of user applied indicia includes self adhesive stickers or appliqués sized to be received on a surface of a tool or article. Many other suitable marking means may be used without departure from the intended scope of the invention.

The present invention is particularly suited to its embodiment as a kit with which components for commonly marking tools of like size selected from each of various tool families, or other articles to indicate commonality of a selected characteristic thereof of members from various article families, can be provided so that the user has at hand, with purchase of a kit, all that is needed to achieve that end. Such a kit would contain a plurality of user selectable marking means, such as for example, variously configured bands, each particularly suited for application to a corresponding article or tool type to be marked, of one of the several families of articles or tools having differing structural configuration. In an advantageous embodiment, the variously configured bands are constructed from a heat shrinkable material to permit fixed application to the various types and sizes of tools or articles by application of heat.

Figure 3:
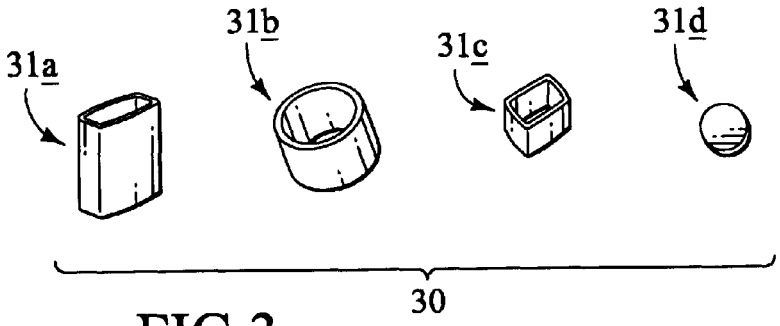
FIG. 3 is a perspective view of a kit in accordance with the invention enabling the selective user application of a suitable one of variously configured heat shrinkable and adhesive backed marking appliqués to each of several analogously configured families of tools.

Referring now to FIG. 3, there is shown, generally at 30, a marking kit which includes a group of variously configured marking appliqués 31*a*, 31*b*, 31*c* and 31*d*. Each of marking appliqués 31*a*, 31*b*, 31*c* and 31*d* are depicted as having a unique structural configuration particularly suited for user-application to a one of a particular tool family (or other article as desired). In the depicted example, only one of each configuration is shown, however a kit may advantageously include a number of each type of each structure in a variety of different colors, and or patterns, to permit common marking of like sized tools from differently configured functionally analogous families, where a number of sizes are to be discretely marked for simplified collation in accordance with the invention. Alternatively, kits may be offered, each which contains several differently configured applique of one particular color or pattern, the user purchasing several different kits to have at hand a sufficient selection of colors and or patterns for the various sizes contained in the different tool sets to be marked for later collation during use. It is noted that other types of marking applique in addition to the structural examples depicted in FIG. 3 may also be included in such a kit without departure from the intended scope as claimed herein. Marking appliqués 31*a*, 31*b*, 31*c* are bands, advantageously constructed from a heat shrinkable material to permit fixed application to the various types and sizes of tools or articles by application of heat. For example, marldng applique 31*a* and 31*c* would likely be suited for application to a wrench handle of rectangular cross-section, and marking applique 31*b* to fixation about a socket wrench. Marking applique 31*d* is a self-adhesive sticker, useful for application to articles and tools of any shape. Although depicted as having a circular shape, marking applique 31*d* may be shaped in any desired manner, such as a diamond, star, square, etc., to provide an additional (supplementary) collation parameter (i.e. shape as well as color and/or pattern) as described above in an prior embodiment.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for collating commonly sized functionally analogous tools included in at least two sets having differing structural configuration, the method comprising the steps of:

applying commonly assigned visual indicia on selected tools of like size, at least two of said selected tools of like size being of differing structural configuration, said indicia containing at least one non-numerical identifying parameter;

determining a correct fit of a one of said at least two of said selected tools with a workpiece;

observing said indicia on said one of said at least two of said selected tools; and collating a remainder of said at least two of said selected tools by matching said indicia carried on each, with said indicia on said one of said at least two of said selected tools.

2. The method according to claim 1, wherein said at least one non-numerical identifying parameter includes at least one of a color and a pattern.

3. The method according to claim 1, wherein said indicia includes a parameter comprising a region of selected and recognizable shape.

4. The method according to claim 1, wherein said indicia includes a plurality of identifying parameters.

5. The method according to claim 1, wherein said indicia is describable in verbal terms.

6. A kit for collation of commonly sized tools having differing structural configuration, said kit comprising:

at least two marking appliqués, each including means for application to a corresponding one of at least two tools of like size each selected from distinct tool families; and said at least two marking appliqués having a commonly assigned visual indicia, said visual indicia including at least one non-numerical identifying parameter, whereby a user of said kit can apply said marking appliqués to said at least two tools to permit collation of a remainder of said at least two of said tools to a one of said tools found to fit a workpiece, by matching said indicia carried on each with said indicia on said one of said tools.

7. The kit according to claim 6, wherein said at least one non-numerical identifying parameter includes at least one of a color and a pattern.

8. The Kid according to claim 6, wherein said indicia includes a parameter comprising a region of selected and recognizable shape.

9. The kit according to claim 6, wherein said indicia includes a plurality of identifying parameters.

10. The kit according to claim 6, wherein said indicia is describable in verbal terms.

11. A method of collating, by common size, functionally analogous tools of differing structural configuration in a group comprised of a plurality of tools, the group including at least two tool families having differing structural configuration from one another, the method comprising the steps of:

providing distinct visual indicia of a same type on commonly sized tools of said at least two tool families, said indicia containing at least one non-numerical identifying parameter;

comparing at least one tool from a selected one of said at least two tool families with a workpiece to determine a correctly sized tool; and collating commonly sized tools in a remainder of said at least two tool families by matching said indicia provided on said correctly sized tool with others in the group having like indicia, whereby once a correct fit with a particular workpiece is determined for a given tool from a one family of tools, a tool in another family of tools of like size may be readily substituted therefor for work on said particular workpiece.

12. The method according to claim 11, wherein said at least one non-numerical identifying parameter includes at least one of a color and a pattern.

13. The method according to claim 11, wherein said indicia includes a parameter comprising a region of selected and recognizable shape.

14. The method according to claim 11, wherein said indicia includes a plurality of identifying parameters.

15. The method according to claim 11, wherein said indicia is describable in verbal terms.

* * * * *